US007342193B2

(12) United States Patent
Chang et al.

(10) Patent No.: US 7,342,193 B2
(45) Date of Patent: Mar. 11, 2008

(54) ELECTRONIC APPARATUS WITH AN ELECTROSTATIC DISCHARGING STRUCTURE

(75) Inventors: Arthur Chang, Taipei (TW); Yu-Feng Huang, Taipei (TW)

(73) Assignee: ASUSTeK Computer Inc., Taipei (TW)

( * ) Notice: Subject to any disclaimer, the term of this patent is extended or adjusted under 35 U.S.C. 154(b) by 0 days.

(21) Appl. No.: 11/390,147

(22) Filed: Mar. 28, 2006

(65) Prior Publication Data

US 2006/0221535 A1 Oct. 5, 2006

(30) Foreign Application Priority Data

Mar. 30, 2005 (TW) ..... 94110119 A

(51) Int. Cl.
*H01H 9/12* (2006.01)

(52) U.S. Cl. ..... 200/305; 200/304

(58) Field of Classification Search ..... 200/304, 200/305, 293, 314, 341; 361/212, 220
See application file for complete search history.

(56) References Cited

U.S. PATENT DOCUMENTS 5,401,926 A 3/1995 Aoyama et al.
5,513,078 A * 4/1996 Komrska et al. ..... 200/305
5,661,279 A * 8/1997 Kenmochi ..... 200/314
5,664,667 A * 9/1997 Kenmochi ..... 200/314
6,580,043 B1 * 6/2003 Spratte ..... 200/517
7,002,086 B2 * 2/2006 Fuji ..... 200/305

FOREIGN PATENT DOCUMENTS

JP 9-245986 A 9/1997
TW 224483 B 11/2004

* cited by examiner

*Primary Examiner*—Elvin Enad
*Assistant Examiner*—M. Fishman
(74) *Attorney, Agent, or Firm*—Birch, Stewart, Kolasch & Birch, LLP

(57) ABSTRACT

An electronic apparatus with an electrostatic discharging structure is disclosed. The electronic apparatus includes a key cap, a switch component, a discharging conductor, a grounding point and a circuit board. The switch component is mounted on the circuit board. The key cap is installed on the switch component. The grounding point is used to make contact with the ground of the electronic apparatus and is formed on the circuit board. The discharging conductor extends from a side of the key cap. When the key cap is pressed by a user, a part of the discharging conductor approaches or makes contact with the grounding point.

6 Claims, 2 Drawing Sheets

ELECTRONIC APPARATUS WITH AN ELECTROSTATIC DISCHARGING STRUCTURE

RELATED APPLICATIONS

The present application is based on, and claims priority from, Taiwan Application Serial Number 94110119, filed Mar. 30, 2005, the disclosure of which is hereby incorporated by reference herein in its entirety.

BACKGROUND

1. Field of Invention

The present invention relates to an electronic apparatus. More particularly, the present invention relates to an electronic apparatus with an electrostatic discharging structure.

2. Description of Related Art

The keypad or keyboard has become an important communication component between an electronic apparatus and a user. Because the keypad enables quick and convenient input, it has been widely applied to many systems, including personal computers, mobile phones and electronic dictionaries.

It do not have many problems in using the key in the past since the key structure has not been very complex. However, because electronic products nowadays are becoming so miniaturized with advances in manufacturing techniques, problems in using the key are gradually appearing. One of these problems is vulnerability to electrostatic damage.

FIG. 1 shows the structure of a conventional electronic apparatus 100. The structure includes a key cap 102 and a switch component 104. The key cap is used to be an interface touched by a user; therefore, the key cap has a flat surface on the top in general. The key cap 102 is installed on the switch component 104 mounted on a circuit board 106 such as a printed circuit board (PCB), wherein the switch component 104 may be a push-button switch. An electronic component 108 is further disposed on the circuit board 106.

According to fundamentals of electrical science, the human body generally holds some electrostatic charge. The transfer of this electrostatic charge into the electronic apparatus 100 when a user touches the key cap 102 is hard to avoid. Moreover, the surface of the key cap 102 may be coated with a metal layer by an electroplating or sputtering process for aesthetics and durability, but this accelerates the electrostatic charge transfer into the electronic apparatus 100.

According to the foregoing description, the spatial volume of advanced electronic products is decreasing and the density of their electronic components is increasing; therefore, the electronic component 108 is easily penetrated and damaged by the electrostatic charge transferring into the electronic apparatus 100. As shown in FIG. 1, when the user touches the surface of the key cap 102, the electrostatic charge on the body of the user will transfer along a discharge path 110 and pass through and possibly damage the component 108 on the circuit board 106.

The conventional method used for preventing the above-mentioned phenomenon is to obstruct the electrostatic charge transfer to other electronic components. An insulating plastic material layer (not shown in the figure), such as Mylar, can be used to be located between the key cap 102 and the switch component 104 to obstruct the electrostatic charge transfer from the body of the user into the electronic apparatus 100.

The conventional obstructing method is still not a fundamental solution. When the quantity of electrostatic charge has accumulated to a certain level, the plastic may be unable to obstruct further electrostatic charge, allowing a great quantity of charge to flash in a short time to damage the electronic component 108. Therefore, an electronic apparatus which is able to fundamentally prevent the damage caused by electrostatic charge is needed in practice.

SUMMARY

It is therefore an objective of the present invention to provide an electronic apparatus with an electrostatic discharging structure.

According to the foregoing objectives of the invention, the electronic apparatus according to an embodiment of the present invention includes a key cap, a switch component, a discharging conductor, a grounding point and a circuit board. The switch component is mounted on the circuit board and the key cap is installed on the switch component. The grounding point is formed on the circuit board and used to connect with a ground of the electronic apparatus. The discharging conductor extends from a side of the key cap. When the key cap is pressed by a user, the end of the discharging conductor contacts with or approaches the grounding point.

BRIEF DESCRIPTION OF THE DRAWINGS

These and other features, aspects and advantages of the present invention will become better understood with regard to the following description, appended claims and accompanying drawings where:

DESCRIPTION OF THE PREFERRED EMBODIMENTS

Figure 1:
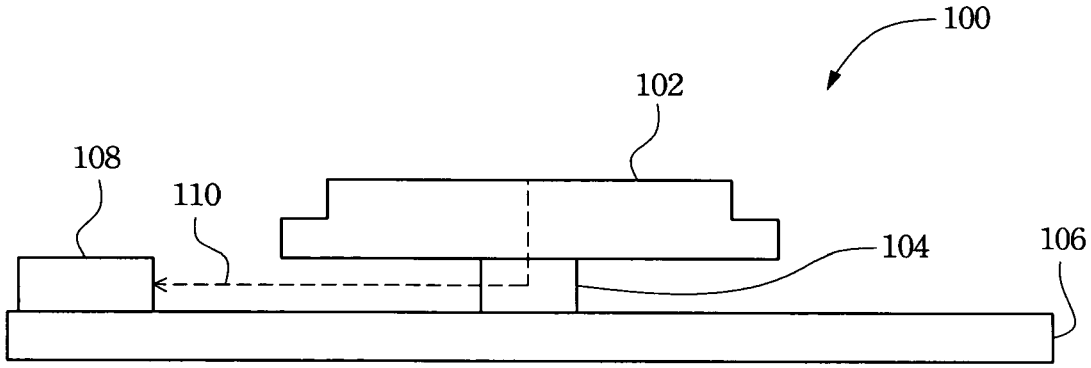
Fig. 1 (PRIOR ART)
FIG. 1 is a lateral view of a conventional structure of an electronic apparatus.

Reference will now be made in detail to the present preferred embodiments of the invention, examples of which are illustrated in the accompanying drawings. Wherever possible, the same reference numbers are used in the drawings and the description to refer to the same or like parts.

Electrostatic charge may damage the electronic components in an electronic product. The key cap or keyboard key is a major medium for the transfer of electrostatic charge into the electronic product. The conventional electrostatic obstructing structure is unable to fundamentally solve the problem caused by the electrostatic charge. The basic concept of the present invention is to drain the electrostatic charge to a grounding point for preventing any electronic component in the electronic product from being damaged by the electrostatic charge.

Figure 2:
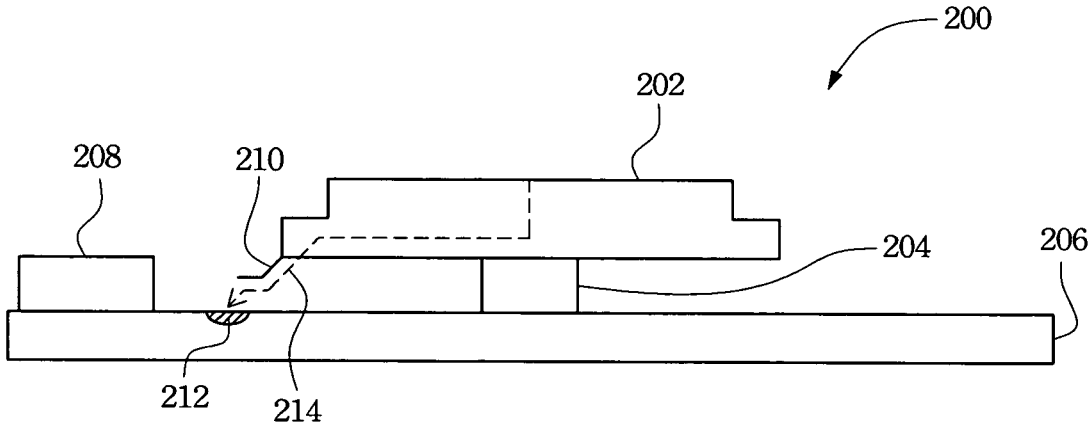
FIG. 2 is a lateral view of the structure of the electronic apparatus according to an embodiment of the present invention.

FIG. 2 shows the structure of an electronic apparatus 200 according to an embodiment of the present invention. At least one electronic component 208 and a switch component 204 are mounted on the surface of the circuit board 206, and a key cap 202 is installed on the switch component 204, wherein the electronic component 208 represents a electronic component on the circuit board 206 that is closest to the key cap 202 and the switch component 204.

The switch component may be a push-button switch in general, and the key cap 202 installed on the switch component 204 is used to be an interface touched by a user; hence, the key cap 202 may have a flat upper surface. The surface of the key cap 202 may further be coated with a metal layer for aesthetics and durability of the electronic apparatus 200.

When the key cap 202 is pressed by the user, the switch component 204 is pressed also; at this time, the electrostatic charge on the body of the user may transfer into the circuit board 206 through the key cap 202 and further influence or damage the electronic component 208 on the circuit board 206. Therefore, a discharging conductor 210 is used in the electronic apparatus 200 to drain the electrostatic charge transferring into the key cap 202. The discharging conductor 210 is extended from a side or the bottom of the key cap 202 in this embodiment. When the key cap 202 is pressed by the user, a part of the discharging conductor 210, such as the end of the discharging conductor 210, makes contact with or approaches the circuit board 206. In this embodiment, a grounding point 212 is formed on the surface of the circuit board 206 that is close to or makes contact with the discharging conductor 210, wherein the grounding point 212 is connected to aground on the circuit board 206.

According to the design of the structure, when the key cap 202 is pressed by the user, a discharge path 214 is formed between the user and the grounding point 212 due to a part of the discharging conductor 210 making contact with or getting close to the grounding point 212. Thus, the electrostatic charge from the user is drained to the grounding point along the discharge path 214, and the electronic component 208 is not influenced or damaged by the electrostatic charge.

Figure 3:
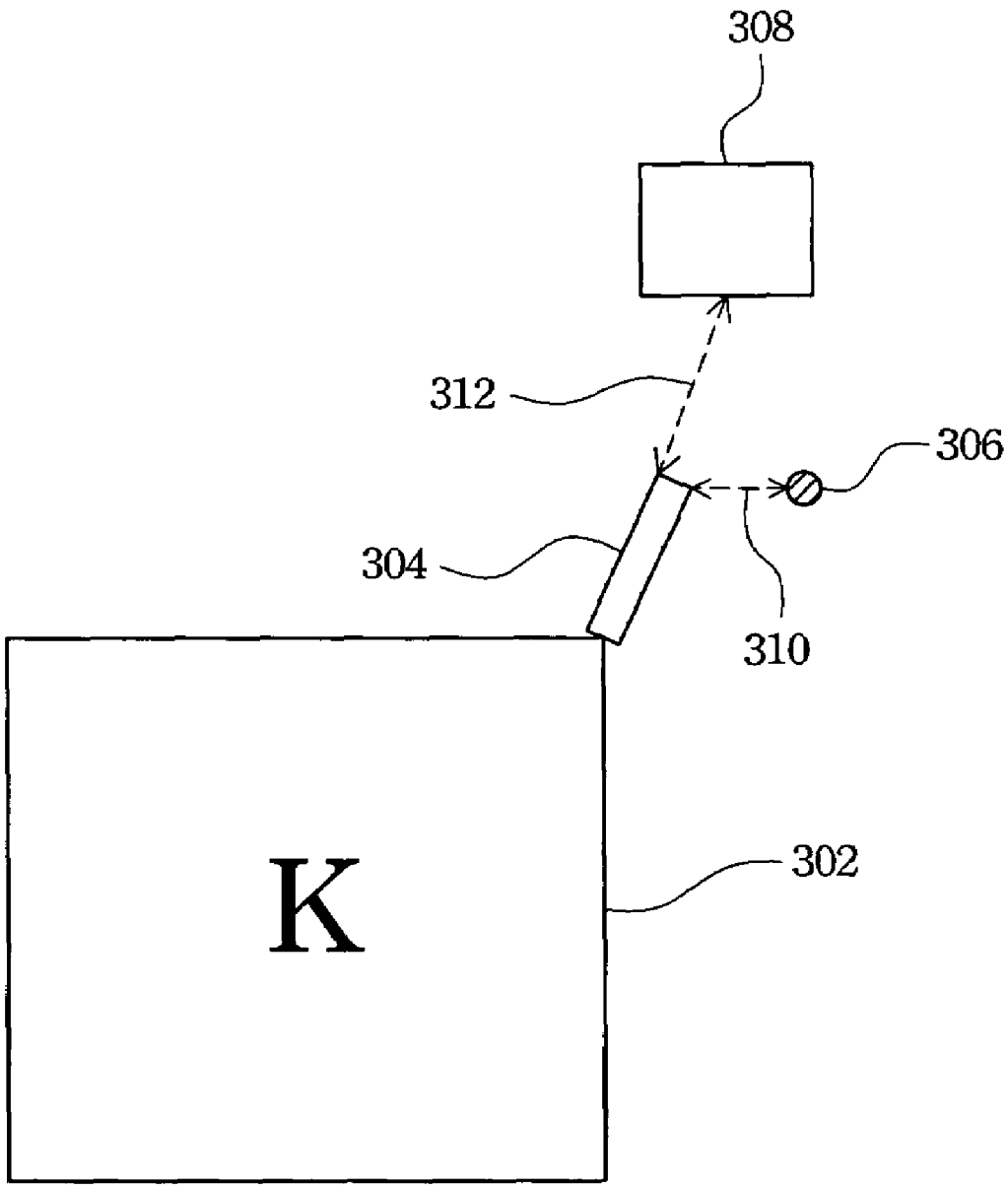
FIG. 3 is a vertical view of the structure of the electronic apparatus according to another embodiment of the present invention.

The discharging conductor 210 is discussed herein. The material of the discharging conductor 210 is not limited; it may be any kind of conductor, such as a metal or a material coated with a metal layer. Only if the discharging conductor 210 do not obstruct the action of the key cap 202 and the switch component 204, the discharging conductor 210 may be any shape and disposed at any location adjacent to the key cap 202. In practice, only if the grounding point 212 is the component closest to the discharging conductor 210, the discharging conductor 210 does not necessarily contact with the grounding point 212 when the key cap 202 is pressed. FIG. 3 shows a vertical view of another embodiment of the present invention, wherein a discharging conductor 304 is extended from key cap 302. When the key cap 302 is pressed by a user, the discharging conductor 304 does not contact with a grounding point 306. If there is a electronic component 308 close to the key cap 302, the electrostatic charge can still be drained to the grounding point 306 as long as a first distance between the discharging conductor 304 and the grounding point 306 is shorter than a second distance between the discharging conductor 304 and the electronic component 308.

According to the foregoing description, providing a grounding point close to each key cap in an electronic apparatus. But a plurality of key caps also can share one grounding point as long as the grounding point close to these key caps.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An electronic apparatus with an electrostatic discharging structure, comprising:

a circuit board;

at least one switch component mounted on said circuit board;

at least one key cap installed on said switch component;

at least one discharging conductor extending from a side of said key cap to the outside of the key cap;

at least one grounding point formed on said circuit board, wherein said discharging conductor approaches said grounding point when said key cap is pressed; and at least one electronic component mounted on said circuit board, wherein the distance between said discharging conductor and said grounding point is shorter than the distance between said discharging conductor and said electronic component when said key cap is pressed.

2. The electronic apparatus of claim 1, wherein said discharging conductor makes contact with said grounding point when said key cap is pressed.

3. The electronic apparatus of claim 1, wherein said circuit board is a printed circuit board (PCB).

4. The electronic apparatus of claim 1, wherein said switch component is a push-button switch.

5. The electronic apparatus of claim 1, wherein a surface of said key cap is coated with a metal layer.

6. The electronic apparatus of claim 1, wherein a surface of said discharging conductor is coated with a metal layer.

* * * * *